United States Patent [19]

Willard et al.

[11] 4,078,296

[45] Mar. 14, 1978

[54] HOT TOP LINING SET AND METHOD OF ASSEMBLING

[76] Inventors: David Charles Willard, R.R. No. 1, Ariss, Ontario, Canada, N0B 1B0; Frank Neat, 38 Water Street, Elora, Ontario, Canada, N0B 1S0

[21] Appl. No.: 692,081

[22] Filed: Jun. 2, 1976

[30] Foreign Application Priority Data

Jun. 4, 1975 United Kingdom ..... 24128/75

[51] Int. Cl.[2] ..... B22D 7/10

[52] U.S. Cl. ..... 29/432; 29/526 R; 164/137; 249/202

[58] Field of Search ..... 164/137; 249/197, 106, 249/202; 29/432, 526

[56] References Cited

U.S. PATENT DOCUMENTS

| | | | |
|---|---|---|---|
| 3,046,625 | 7/1962 | Carpenter | 249/202 X |

FOREIGN PATENT DOCUMENTS

| | | | |
|---|---|---|---|
| 24,851 | 7/1972 | Japan | 249/197 |
| 197,025 | 7/1965 | Sweden | 164/137 |
| 1,376,944 | 12/1974 | United Kingdom | 249/197 |

*Primary Examiner*—Robert D. Baldwin

*Attorney, Agent, or Firm*—Caesar, Rivise, Bernstein & Cohen, Ltd.

[57] ABSTRACT

Ingot mould lining slabs have one or more apertures in their metal contacting face. Hooks are engaged in these and used to lift the slab from a stack and hang it in position in an ingot mould. The slab is then fixed to the mould wall, for example by nailing, and then the hooks are removed.

5 Claims, 13 Drawing Figures

HOT TOP LINING SET AND METHOD OF ASSEMBLING

Figure 1:
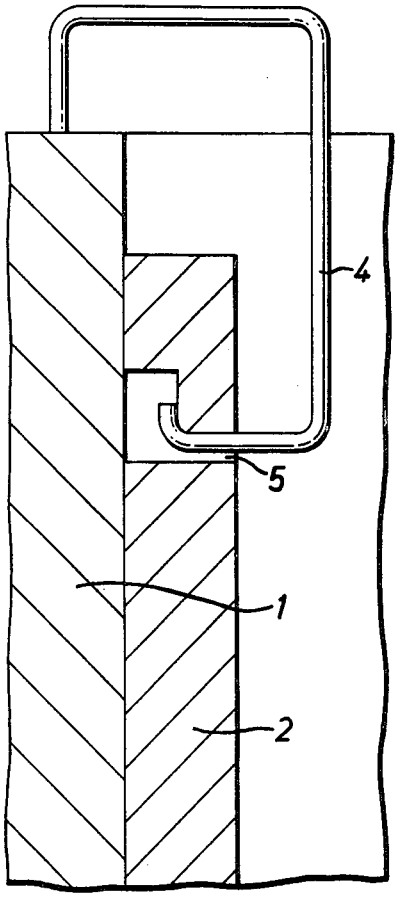

This invention relates to hot topping.

In the casting of molten metals to form ingots, it is common practice to line the head of the ingot mould with lining slabs. These may be of heat-insulating or exothermic nature and they serve to delay the solidification of the head metal after the molten metal has been poured into the mould. This delay ensures that during the solidification of the ingot, molten metal can feed from the head to the body of the ingot to compensate for the shrinkage on solidification, thus avoiding the incidence of cracks and fissures running from the head of the ingot and known as "pipe".

Over the past forty years many systems have been proposed and discussed for lining the head of an ingot mould with a plurality of lining slabs.

One type of operation which is widely practiced is to locate a plurality of heat-insulating slabs adjacent the walls of the ingot mould at its head and then fix these slabs in position by nailing. Ingot moulds are customarily made of cast iron and the slabs may be fixed by firing steel nails into the slab to penetrate the metal face of the interior wall of the ingot mould. A variety of cartridge loaded guns is available for this purpose. The operation of locating and fixing such slabs is known as lining the head of the mould.

In order to be able to line the head of the mould efficiently, it is necessary to hold the lining slabs in the correct position while nailing. This would require two operatives if done by hand, and in any case, since the ingot moulds to be lined are often hot, manual operation is not possible. One known practice is to locate hanger straps on one face of each slab which, by engagement over the top edge of the ingot mould, hang the slab in position until it is nailed. These hanger straps may subsequently be left in position or they may be removed. If they are left in position, they become destroyed during the subsequent casting and stripping process and this is clearly uneconomic. If, on the other hand, they are removed and reused, considerable manual effort is required to re-process them.

According to the present invention there is provided a method of lining an ingot mould with one or more lining slabs to form a hot top, wherein the or each slab has, extending from its face destined to contact molten metal, at least one hole, which comprises engaging at least one lifting hook having at least one prong in the hole(s) in the slab, the lifting hook(s) being so shaped that the slab may be hung thereon with interengagement of part of the hook(s) with the top edge of the mould wall with the slab in the desired position, engaging the hook(s) on the top edge of the mould wall to hang the slab in the desired position, fixing the slab to the mould wall and removing the hook(s).

The hook or hooks may be reused and may be considered simply as a tool. The preferred number of holes in the slabs is two and accordingly if a single hook is used, it preferably has two prongs. Alternatively, two hooks may be used, each having one prong.

The shape of the holes in the slab may vary widely and corresponding variation in the prong shape or number may also occur. An elongate hole may be engaged by a two pronged hook. The holes in the face of the slab may pass through the slab or may be blind holes. It is found that in the case where the holes do pass through the slab, molten metal penetration on casting is not a serious difficulty and does not adversely affect the heat-insulating or exothermic performance of the lining slab. Although a simple cylindrical hole going part or the whole of the way through the slab is satisfactory, we have found it more satisfactory to provide the hole with a key configuration, for example, by providing it tapering outwardly from the front face of the slab towards the rear or having one or more sections undercut as seen from the molten metal-contacting face of the slab. Such a configuration allows much more positive engagement of the prong of the hook with the slab and facilitates handling; the engaged hook cannot be removed simply by moving it in a direction perpendicular to the face of the slab. It is desirable that at least part of the prong of the hook, when engaged with the slab in the desired position, extend in a direction not normal to the face of the slab destined to contact molten metal.

The means for engagement with the upper edge of the ingot mould is preferably a simple prong or the like which will, without difficulty, engage sufficiently well by friction on the upper edge of the ingot mould to hold the slab in place while it is being nailed in position.

The attached figures show diagrammatically, various ways of putting the invention into effect. In each figure the ingot mould is denoted 1, the slab 2, subsequent nails 3, the lifting and positioning tool(s) 4, and the aperture or apertures 5.

Figure 2:
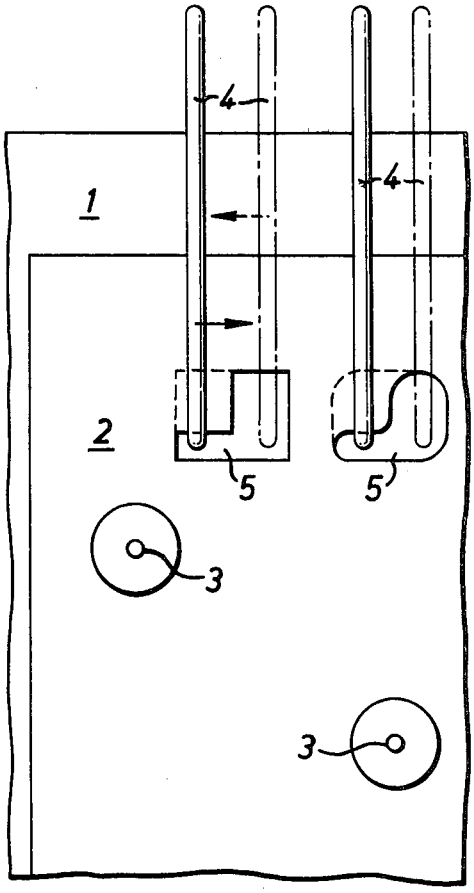

FIGS. 1 and 2 show side section and plan views respectively of a simple system according to the invention. In FIG. 2 two different hole configurations are shown though normally the two holes on one and the same slab would have the same configuration. This is for convenience rather than of necessity.

Figure 3A:
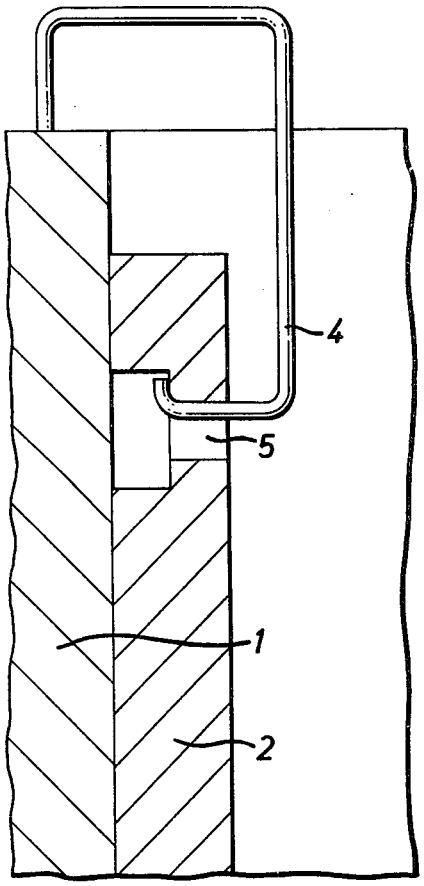
Figure 3B:
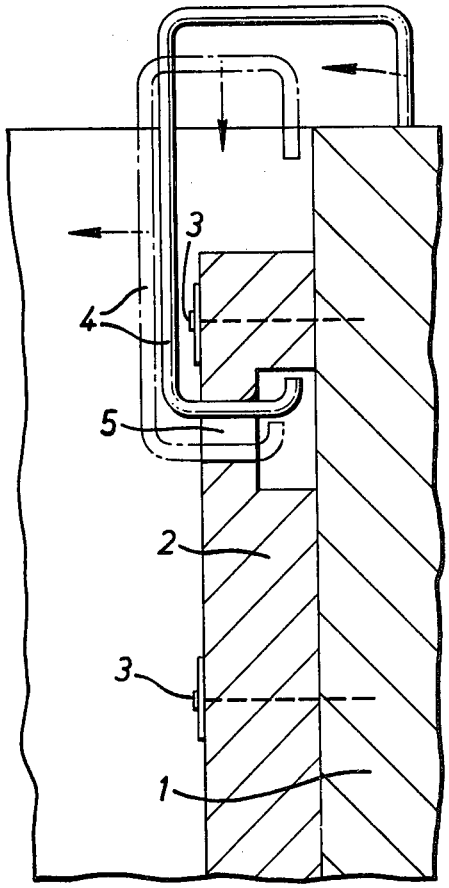

FIGS. 3*a* and 3*b* show two sections of the same arrangement. In FIG. 3*a* the stage is where the slab has been lifted into position and is ready for nailing. FIG. 3*b* shows a sequence of tool removal after nailing.

Figure 4A:
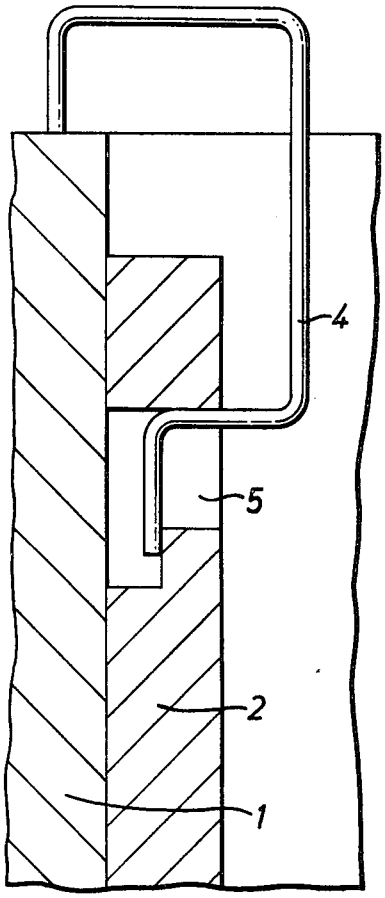
Figure 4B:
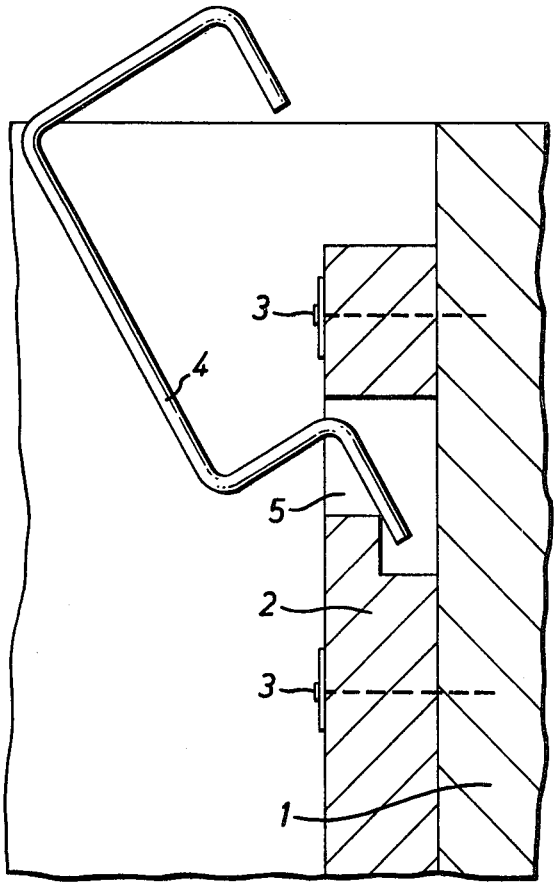

FIG. 4*a* shows an alternative configuration in position for nailing and FIG. 4*b* how the tool is removed after nailing.

Figure 5A:
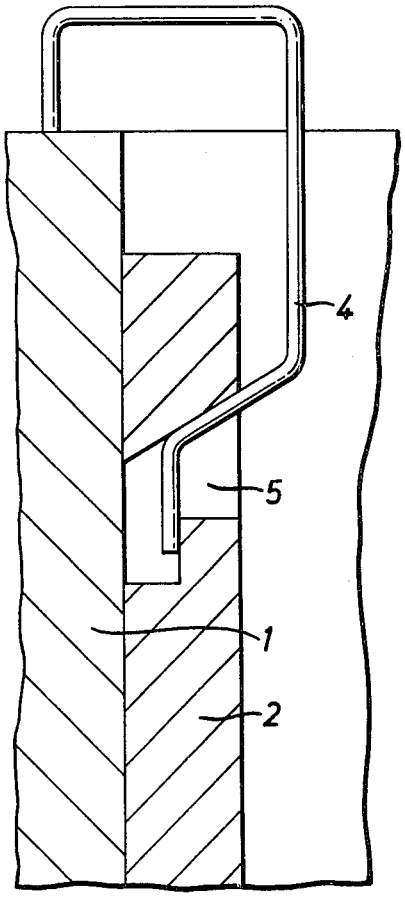
Figure 5B:
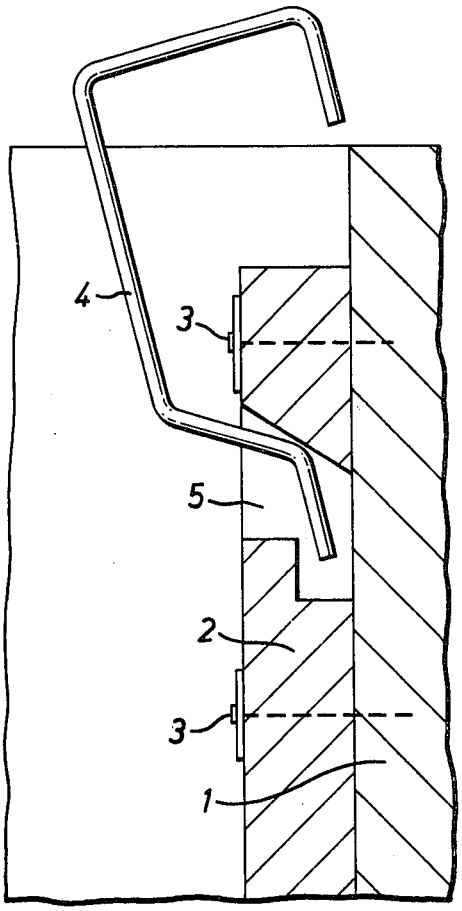

FIGS. 5*a* and 5*b* are similar to FIGS. 4*a* and 4*b* but showing an alternative hole and tool configuration.

Figure 6A:
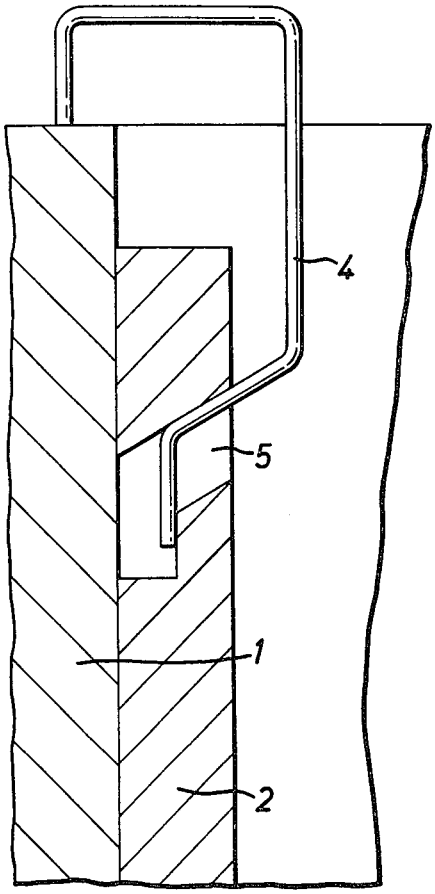
Figure 6B:
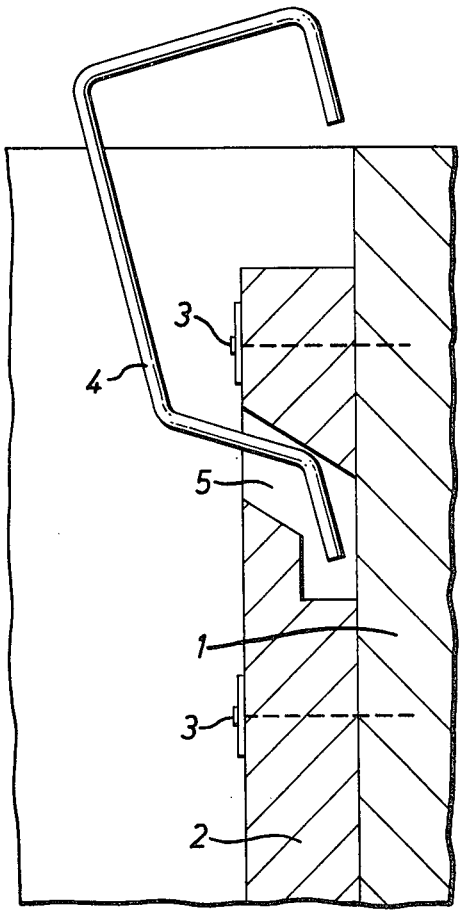

FIGS. 6*a* and 6*b* show a further alternative hole configuration, though the tool is the same shape as that shown in FIGS. 5*a* and 5*b*.

Figure 7A:
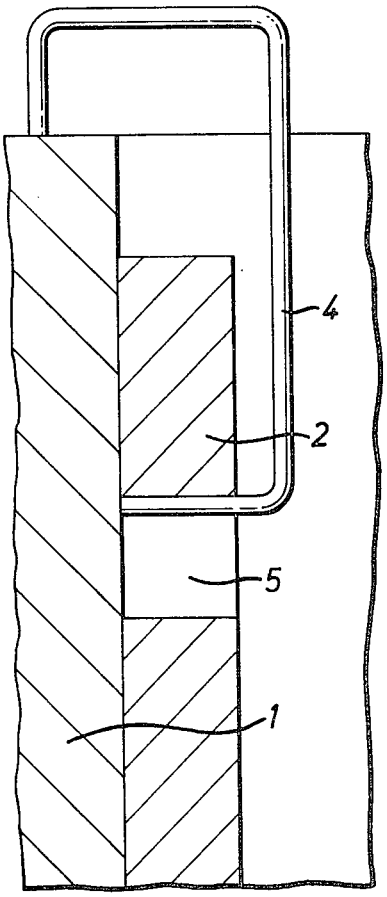
Figure 7B:
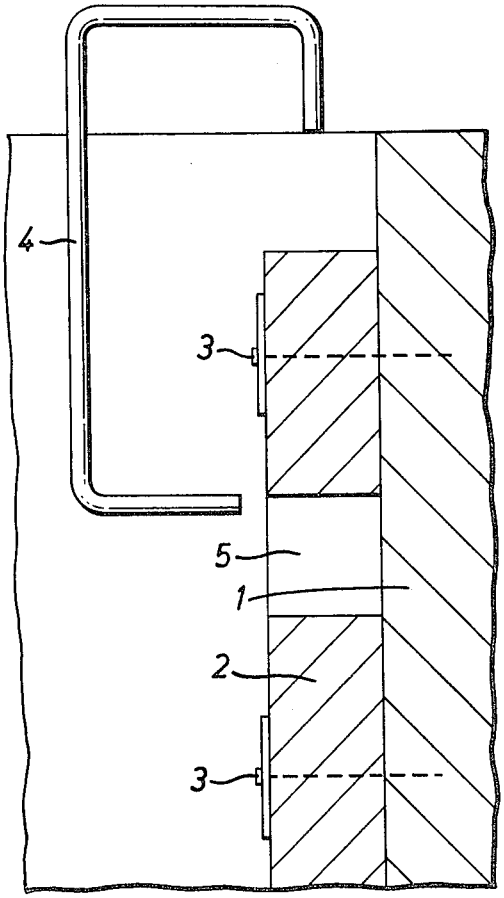

FIGS. 7*a* and 7*b* show yet a further alternative hole and tool configuration.

Figure 8:
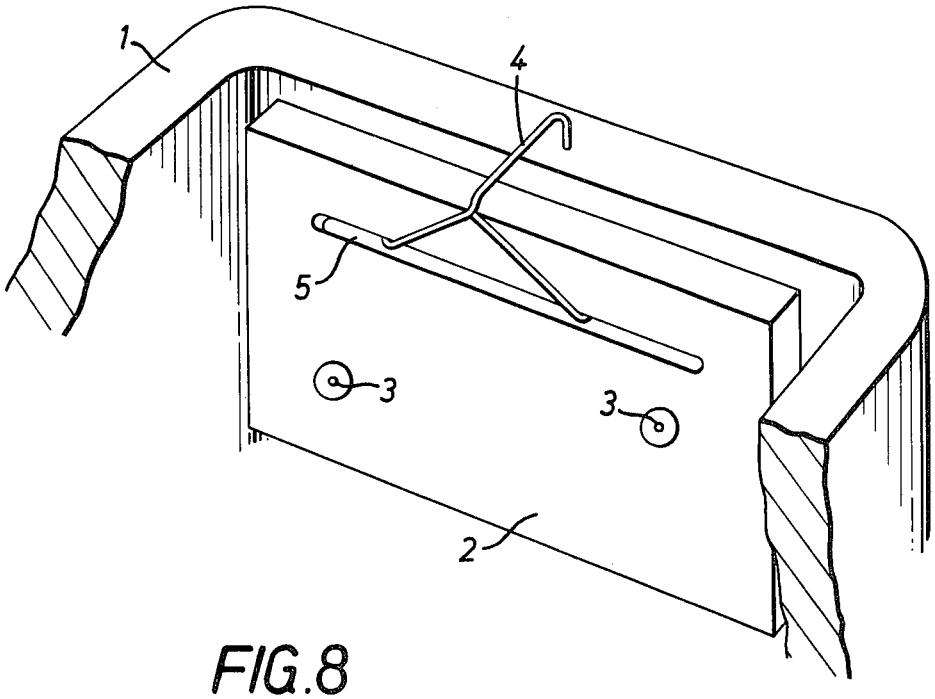

FIG. 8 shows a system in which each slab has a single elongate shallow blind hole and in which a single hook 4 engages therein with two prongs.

The holes in the slabs can easily be incorporated in manufacture by locating an appropriate block or core in the mould in which the slabs are formed.

It is found that the system according to the present invention enables considerable savings and increases in efficiency. The tools used for setting up are very simple and cheap to manufacture, being usually made of bent mild steel rod. They are reusable and can be kept at the point of use, i.e. on the casting pit platform. In addition, the slabs are manufactured and can then be packed and despatched, no further processes needing to be undergone such as the attachment of hanger straps or the like. The lack of such straps makes packaging and handling of the slabs easier.

We claim:

1. A hot top lining set for lining an ingot mould having a mould wall, said set consisting of a plurality of hot top lining slabs and a plurality of hooks for holding said slabs in position on the wall of the mould for securement thereto by fastening means, the slabs each having at least two preformed holes therein and each hook having an intermediate portion arranged to extend parallel to the face of a slab and interconnecting a first and a second portion, said first portion being in the form of at least one prong terminating in a free end extending generally parallel to the intermediate portion of said hook, each of said holes being undercut in the form of an entrance portion and an enlarged interior portion, each of said prongs being arranged for receipt within a respective hole with said prong engaging an upper surface of said entrance portion to support said slab, said enlarged portions having a surface arranged to engage the free end of the prong, the entrance portion of said hole being sufficiently large to enable the end portion of the prong to pass therethrough, whereupon when said prong is inserted within said hole it is secured therein against accidental removal, yet can be readily released when desired, the second portion of each of the hooks being arranged to be engaged with the top edge of the wall of said mould to hold said slabs in said desired position.

2. A method of lining an ingot mould having a mould wall with a plurality of lining slabs to form a hot top assembly, each of said slabs including at least one preformed hole extending from the face of the slab destined to be contacted by molten metal, said method comprising engaging each of said slabs with at least one lifting hook, said hook including an intermediate portion extending parallel to the face of the slab and interconnecting a first and a second portion, said first portion being in the form of at least one prong terminating in a free end extending generally parallel to the intermediate portion of said hook and which when said hook is engaged with the slab extends into the hole, said hole being undercut in the form of an entrance portion and an enlarged interior portion, said prong engaging an upper surface of said entrance portion to support said slab, said enlarged portion having a surface engaging the free end of said prong, the entrance portion of said hole being sufficiently large to enable the end portion of said prong to pass therethrough, whereupon when said prong is inserted within said hole it is secured therein against accidental removal, yet can be readily released when desired, lifting the slab on said hook, hanging said slab in the desired position on the edge of the mould wall by engaging the second portion of said hook on the top edge of the mould wall, fixing the slab to the mould wall by the use of fastening means and thereafter removing said hook from said hole to leave the slab fixed in place on the mould wall by said fastening means.

3. The method according to claim 1 wherein each slab includes two preformed holes, and wherein two lifting hooks are used for each slab with each hook having one prong.

4. The method according to claim 1 wherein each slab includes an elongate preformed hole and one hook having two prongs is used, the prongs being engaged at spaced locations in the elongate hole.

5. The method according to claim 1 wherein said fastening means comprises nails and wherein the slabs are fixed in position to the mould wall by nailing.

* * * * *